US007011496B2

(12) United States Patent
Sun

(10) Patent No.: US 7,011,496 B2
(45) Date of Patent: Mar. 14, 2006

(54) RING UNIT FOR DECREASING EDDY FLOW AREA OF A FAN MODULE

(75) Inventor: Sung-Wei Sun, Taipei (TW)

(73) Assignee: Asia Vital Component Co., Ltd., Kaohsiung (TW)

( * ) Notice: Subject to any disclaimer, the term of this patent is extended or adjusted under 35 U.S.C. 154(b) by 128 days.

(21) Appl. No.: 10/813,093

(22) Filed: Mar. 31, 2004

(65) Prior Publication Data

US 2005/0220617 A1 Oct. 6, 2005

(51) Int. Cl.
*F04D 29/54* (2006.01)

(52) U.S. Cl. ..... 415/211.2; 416/196 R; 416/193 R

(58) Field of Classification Search ..... 415/193, 415/199.4, 199.5, 208.2, 209.4; 416/185, 416/188, 193 R, 196 R, 247 R
See application file for complete search history.

(56) References Cited

U.S. PATENT DOCUMENTS

| | | | | |
|---|---|---|---|---|
| 2,616,511 A * | 11/1952 | Perrott | ..... | 416/193 R |
| 3,332,500 A * | 7/1967 | Bristol et al. | ..... | 416/196 R |
| 4,419,052 A * | 12/1983 | Stamm | ..... | 416/214 A |
| 2003/0012653 A1 * | 1/2003 | Diemunsch | ..... | 416/193 R |

* cited by examiner

*Primary Examiner*—Thomas E. Lazo
*Assistant Examiner*—Dwayne J White

(57) ABSTRACT

A fan device for decreasing eddy flow area includes a fan module and a ring unit. The fan module has a fan rotor and a motor stator set and the fan rotor is movably connected to the motor stator set. The motor stator set has a guide flow device, which provides a plurality of guide flow blades. The ring unit provides a plurality of locating slots corresponding to the guide flow blades so as to be inserted with the guide flow blades easily. The ring unit can reduce the eddy flow area formed by way of counter flow reflected from an electronic component under the guide flow device to increase flow rate and speed of the air flow. The ring unit is independently attached to the guide flow device so that it is easy to be mounted to the guide flow device and capable of lowering the production cost.

2 Claims, 3 Drawing Sheets

RING UNIT FOR DECREASING EDDY FLOW AREA OF A FAN MODULE

BACKGROUND OF THE INVENTION

1. Field of the Invention

The present invention is related to a ring unit for decreasing eddy flow area of a fan module and particularly to a fan module in which a ring unit is attached to the guide flow device additionally.

2. Brief Description of Related Art

It is known that a great deal of heat generates during a conventional electronic component being in operation. If the heat is not removed in time, the electronic component will not be operated smoothly so as to decrease integral effect of the computer or the information product. In order to remove the heat effectively, usually a metal radiator and a cooling fan are added to the electronic component to speed up removal of the heat. Taiwanese Patent Publication No. 523652, entitled "COMPOSITE TYPE FAN WITH HEAT DISSIPATION FRAME", provides a first frame and a first flow guide part. The first flow guide part is attached to the first frame and composed of a plurality of static blades, which is radially disposed to increase the flow rate and air pressure of the air flow created by a radiation device. However, the counter air flow reflecting from the electronic component offsets the downward moving air flow from the cooling fan so as to affect the efficiency of the cooling fan.

SUMMARY OF THE INVENTION

The crux of the present invention resides in that a ring unit is added to the guide flow device in the fan module to disperse the counter air flow for reducing offset effect between the downward moving air flow and the counter air flow and increasing speed and flow rate of the downward moving air flow so that the heat of the electronic component can be removed speedily to maintain normal operation of the electronic component. Further, the ring unit is made separately from the fan module as an independent part before being attached to the fan module so that it is low cost for making the ring unit in addition to being mounted to the fan module easily.

Accordingly, an object of the present invention is to provide a ring unit, which is capable of decreasing eddy flow area the guide flow device of the fan module.

Another object of the present invention is to provide a ring unit, which is low cost and easily installed.

A further object of the present invention is to provide a ring unit, which is capable of increasing flow rate of the downward moving air flow blown by the fan rotor.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE PREFERRED EMBODIMENT

Figure 1:
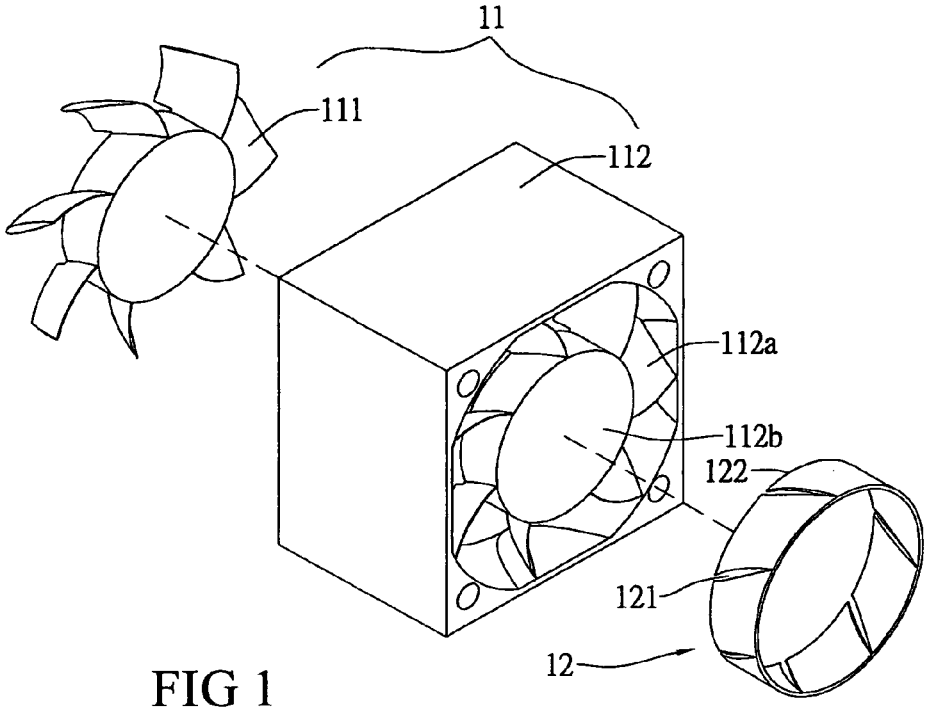
FIG. 1 is a perspective view illustrating a ring unit for decreasing eddy flow area of a fan module according to the present invention being detached from the fan module.
Figure 2:
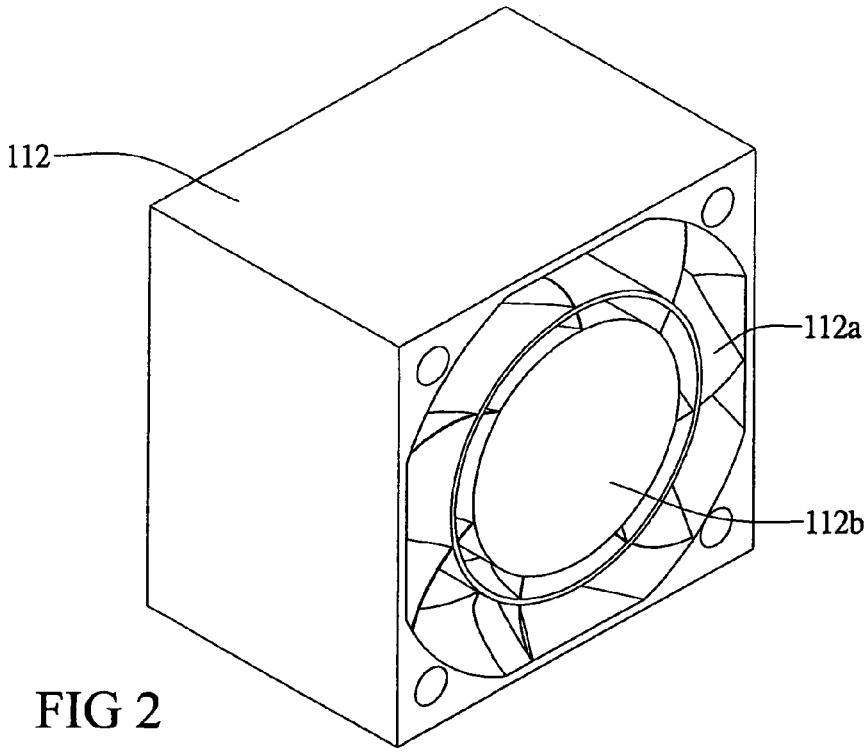
FIG. 2 is a perspective view illustrating the ring unit shown in FIG. 1 being attached to the fan module.
Figure 3:
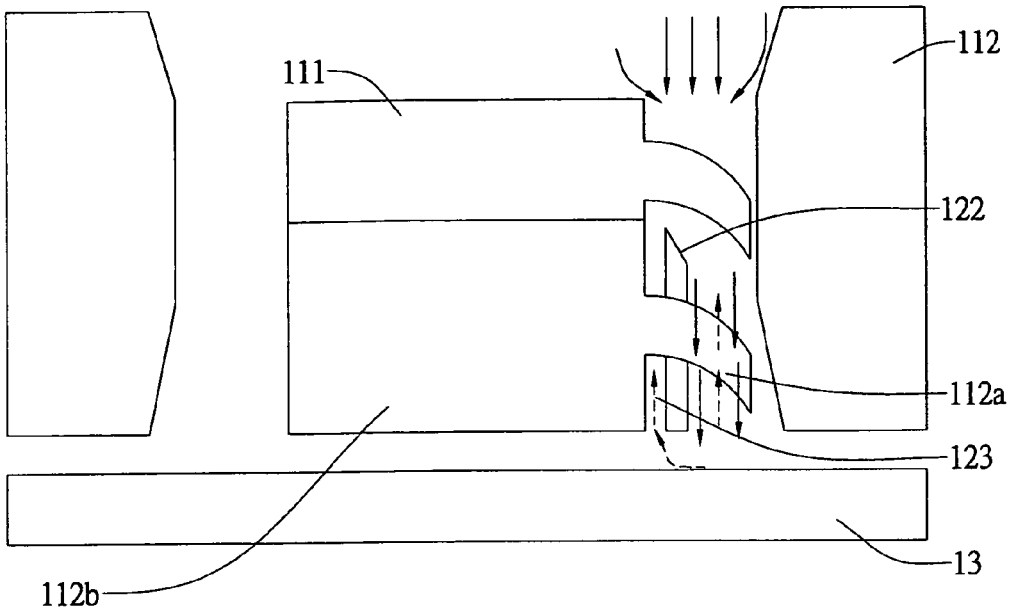
FIG. 3 is a plan view illustrating the air flow due to the ring unit of the present invention.

Referring to FIGS. 1, 2 and 3, a fan device according to the present invention includes a fan module 11 and a ring unit 12. The fan module 11 includes a fan rotor 111 and a motor stator set 112. The motor stator set 112 provides a hub 112*b* with a guide flow device. The guide flow device is composed of a plurality of guide flow blades 112*a*. The ring unit 12 provides a slant and a plurality of locating slots 121 corresponding to the guide flow blades 112*a*.

Referring to FIGS. 2 and 3 again, the fan rotor 111 movably connects with the motor stator set 112 and the locating slots 121 of the ring unit 12 are joined to the guide flow blades 112*a*. Hence, an annular space 123 is formed between the ring unit 12 and the hub 112*b*.

When the fan rotor 111 starts to run, the generated air flow moves downward to an electronic component 13. Counter air flow resulting from the electronic component 13 is formed under the guide flow blades 112*a* and is dispersed by the ring unit 12 while the counter air flow moves backward to the ring unit 12. Hence, the eddy flow area under the guide flow blades 112*a* can be reduced and part of the counter air flow enters the annular space 123. Further, the slant 122 disposed at an edge of the ring unit 12 can guide the downward air flow blown by the fan rotor 111 away from the counter air flow in the annular space 123 so that speed of the downward air flow can be accelerated to enhance the heat dissipation effect of the fan module.

Because the locating slots 121 of the ring unit 12 are provided to fit with the guide flow blades 112*a* so that it is very easy for the ring unit 12 being mounted to the guide flow blades 112*a*. Further, the ring unit 12 is made as a unique unit separating from the motor stator set 112 so that it cost low in addition to being set up conveniently.

Figure 4:
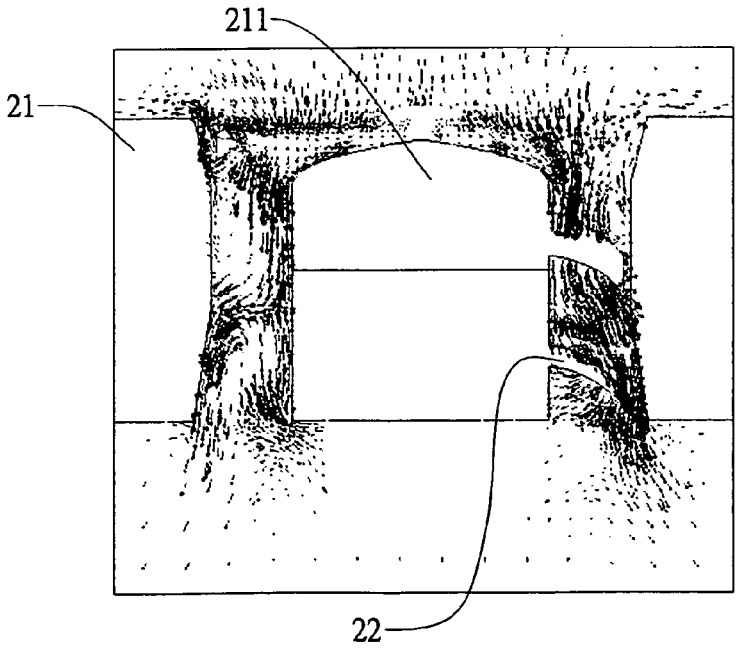
FIG. 4 is a diagram illustrating the air flow experiment of the conventional fan module.
Figure 5:
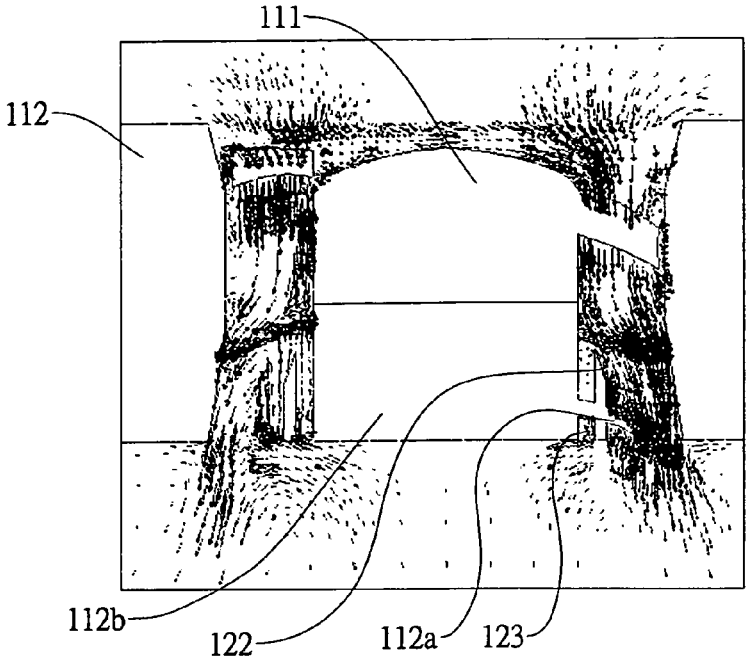
FIG. 5 is a diagram illustrating the air flow experiment of the present invention.

Referring to FIGS. 4 and 5, experimental air flow of a fan module 21 with conventional guide flow device and experimental flow of the present invention are illustrated respectively. It can be seen in FIG. 4 that the fan module 21 is provided with the fan rotor 211 to movably connect with the guide flow device 22. Comparing the air flow under the guide flow blades 112*a* to the air flow under the guide flow blades 22 shown in FIGS. 4 and 5, the guide flow blades 112*a* added with the ring unit 12 can disperse the counter air flow so that it is capable of reducing the eddy flow area under the guide flow blades 112*a* and the slant 122 provided at an edge of the ring unit 12 can accelerate the speed of the downward air flow blown from the fan rotor 111 so that the ring unit 12 is capable of reducing offset effect between the downward air flow and the counter air flow. In this way, the flow rate and the speed of the air flow can be increased during approaching the electronic component 13 and the heat of the electronic component 13 can be removed speedily to maintain normal operation of the electronic component 13.

Figure 6:
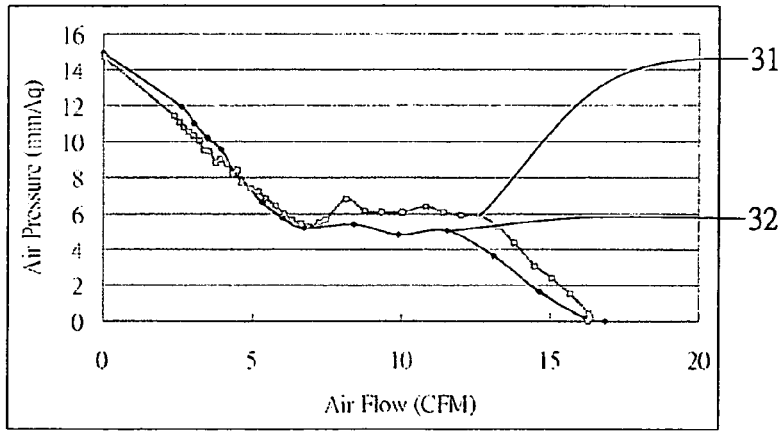
FIG. 6 is a graph illustrating experimental curves of air pressures with respect to air flows for the conventional fan module and the present invention.

Referring to FIG. 6, a graph illustrating experimental curves of the fan module with conventional guide flow device and the fan module with the ring unit of the present invention. The vertical axis represents air pressure, i.e., pressure of the counter air flow and the measure unit thereof is mmAq. The horizontal axis represents air flow, i.e., air flow blown by the fan rotor and the measure unit thereof is cubic feet per minute (CFM). Experimental curve 31 is obtained from the present invention and experimental curve 32 is obtained from the conventional fan module. It can be seen from the experimental curves that the air flow done by the present invention can increase 14% than that done by the conventional device in the high air flow rate zone, i.e., the zone flow rate greater than 12 CFM. It is appreciated that the ring unit 12 of the present invention has decreased the eddy flow area formed by the counter air flow to avoid the eddy flow impeding the downward air flow passage and offsetting the flow rate of the air flow, which are problems of the conventional device. Therefore, the ring unit of the present invention substantially overcomes the problem created by the counter air flow and accelerates the speed of the downward air flow effectively.

While the invention has been described with referencing to a preferred embodiment thereof, it is to be understood that modifications or variations may be easily made without departing from the spirit of this invention, which is defined by the appended claims.

What is claimed is:

1. A fan device for decreasing eddy flow area, comprising:

a fan module with a fan rotor and a motor stator set, the fan rotor being movably connected to the motor stator set, the motor stator set having a guide flow device, which provides a plurality of guide flow blades; and a ring unit, providing a plurality of locating slots corresponding to the guide flow blades so as to be inserted with the guide flow blades;

whereby, the ring unit can reduce the eddy flow area formed by way of counter flow reflecting from an electronic component under the guide flow device to increase flow rate and speed of the air flow.

2. The fan device according to the present invention, wherein a slant is provided at an edge of the guide flow device to enhance increase of the speed of the air flow and guide of the air flow direction.

* * * * *